US006460704B2

(12) United States Patent
Satake et al.

(10) Patent No.: US 6,460,704 B2
(45) Date of Patent: Oct. 8, 2002

(54) ROTARY SHAKING SEPARATOR

(75) Inventors: Satoru Satake, deceased, late of Hiroshima, by Toshiko Satake, legal representative; Akira Fukuhara, Tokyo; Kiminori Kono, Tokyo; Masahide Houri, Tokyo; Shigeki Kinoshita, Tokyo; Masashi Kageyama, Tokyo; Chozaburo Ikuta, Tokyo; Haruyoshi Yamaguchi, Tokyo, all of (JP)

(73) Assignee: Satake Corporation, Tokyo (JP)

( * ) Notice: Subject to any disclaimer, the term of this patent is extended or adjusted under 35 U.S.C. 154(b) by 23 days.

(21) Appl. No.: 09/729,640

(22) Filed: Dec. 5, 2000

(65) Prior Publication Data

US 2001/0002655 A1 Jun. 7, 2001

(30) Foreign Application Priority Data

Dec. 6, 1999 (JP) ..... 11-346845
Nov. 8, 2000 (JP) ..... 2000-339798

(51) Int. Cl.[7] ..... B07B 13/00

(52) U.S. Cl. ..... 209/480; 209/365.4; 209/505; 209/691

(58) Field of Search ..... 209/309, 311, 209/315, 325, 326, 364, 365.1, 365.4, 369, 479, 480, 481, 505, 691, 694

(56) References Cited

U.S. PATENT DOCUMENTS 2,384,715 A * 9/1945 Ward ..... 209/365.1 X
2,464,216 A * 3/1949 Devol ..... 209/365.1 X
5,542,548 A * 8/1996 Senapati ..... 209/365.4 X

FOREIGN PATENT DOCUMENTS

JP 2000-301071 10/2000
SU 1435321 * 11/1988 ..... 209/365.1

* cited by examiner

*Primary Examiner*—Tuan N. Nguyen
(74) *Attorney, Agent, or Firm*—Pillsbury Winthrop LLP

(57) ABSTRACT

A rotary shaking separator for separating unhulled rice and unpolished rice from each other includes at least one separating vessel and a plurality of drives located at even intervals on the peripheral edge of the separating vessel, the plurality of drives being actuated to bring the whole of the separating vessel into a rotationally shaking motion.

12 Claims, 16 Drawing Sheets

ROTARY SHAKING SEPARATOR

FIELD OF THE INVENTION

The present invention relates to a separator for separating unhulled rice and unpolished rice from each other after hulling rice, and in particular, to such type of separator that rotationally shakes a circular separating vessel for the separation.

DESCRIPTION OF THE PRIOR ART

The inventor of the present invention has suggested in the Japanese Patent Application No. H11-106959 a rotary shaking separator which can reduce a space for installing the separator while maintaining separating accuracy of each of a plurality of circular separating vessels at a certain level even if they are arranged in multi-rows. To describe the configuration of this separator with reference to FIG. 13, the separator is designed to have a geometry in which a vertical supporting point "O" of an eccentric revolving motion is arranged above a shaft center of a rotary shaft 13 and an inclination line "P" is extended downwardly from said vertical supporting point "O" with a predetermined inclination angle, and a separating vessel 4A is rotatably mounted to an eccentric portion 22A, 23A formed on said inclination line "P".

FIG. 14 is a schematic view illustrating said separating vessel 4A being revolved by the rotary shaft 13, and FIG. 15 is a schematic top view of the separating vessel 4A. Referring to FIGS. 14 and 15, the separating vessel 4A is supported by an eccentric portion "H" of the rotary shaft 13 inserted through a central portion "S" of the separating vessel 4A to allow the rotary shaft 13 to rotate with respect thereto, while a peripheral edge portion of the separating vessel 4A is supported by a plurality of springs "B" to prevent free rotation thereof (the separating vessel 4A is held and restrained at the central portion thereof by the rotary shaft 13 and at the peripheral edge portion thereof by the plurality of springs "B" respectively so that the motion of the separating vessel 4A is limited to a certain range). As the rotary shaft 13 rotates, the separating vessel 4A is revolved around the rotation center "O" of the rotary shaft 13 by an eccentricity amount "r" (as shown by dotted lines 4A1, 4A2 and 4A3 in FIG. 15), and thereby unhulled rice and unpolished rice in the rice mixture are separated from each other on the separating vessel 4A so that the unhulled rice is discharged through a unhulled rice discharging port disposed in the vicinity of the central portion "S" and the unpolished rice is discharged through an unpolished rice discharging port disposed in the vicinity of the peripheral edge portion.

As for said separating vessel 4A, the rotary shaft 13 is designed to rotate under the condition that a center of gravity "G" of the separating vessel 4A is on the central portion "S" of the separating vessel 4A, but if supply of material to be separated is increased, the center of gravity is offset from the central portion "S" by the eccentricity amount "$\epsilon$", which may result in a failure in separation (G1 in FIG. 14). Furthermore, when stiffness of the springs "B" for preventing the free rotation of the separating vessel 4A gets weaker through a long-term service, a travelling distance of said materials placed on the separating plates of the separating vessel 4A to be separated thereby is possibly varied even along the same radii symmetrical to each other around the central portion "S", resulting in a failure in separation at some locations in the same separating vessel 4A.

Yet further, because the rotary shaft 13 is inserted through the central portion "S" of the separating vessel 4A, the unhulled rice discharging port is necessarily designed to be narrow, which has exhibited some disadvantages that mounting of components is difficult, maintenance thereof is troublesome, and discharge of unhulled rice is not facilitated.

SUMMARY OF THE INVENTION

In the light of the problems described above, an object of the present invention is to provide a rotary shaking separator which prevents a failure in separation in the same separating vessel, allowing a constant separating accuracy to be maintained, without requiring a rotary shaft to be inserted through a central portion of the separating vessel.

To solve the problems described above, the present invention provides in the view of technology a rotary shaking separator comprising a separating vessel having a plurality of segmental separating plates arranged in a cone-shape form and a drive means for rotationally shaking said separating vessel so that once material to be separated, which is mixture composed of unhulled rice and unpolished rice, is supplied into a predetermined location of said separating vessel, said unhulled lice is discharged from a peripheral edge portion of said separating vessel and said unpolished rice is discharged from a central bottom portion of said separating vessel, wherein said separating vessel is supported by a plurality of drive means arranged in peripheral edge portions thereof on the same radii from the center of said separating vessel with arc lengths thereof being equal to one another, and said peripheral edge portions of said separating vessel are sequentially driven elliptically by said plurality of drive means to rotationally shake the whole of said separating vessel. Owing to this arrangement, since the mixture of unhulled rice and unpolished rice supplied into the separating vessel has greater acceleration in the vicinity of the peripheral portions, the unpolished rice having smaller grain size and greater specific gravity is carried toward the peripheral edge direction to be discharged from an unpolished rice discharging port, while the unhulled rice having greater grain size and smaller specific gravity slides down along the cone-shaped separating plates to be discharged from a central bottom portion of the separating vessel, thereby making it possible to retain a constant degree of separating accuracy without any failure in separation which might otherwise occur on the same separating plate and further to provide a rotary shaking separator which requires no rotary shaft inserted through the central portion of the separating vessel.

Further, it is preferable that the rotary shaking separator has a plurality of electric motors each being provided corresponding to each of a plurality of drive means. In this case, it is preferable that, in order to operate the plurality of electric motors synchronously, the apparatus comprises a measuring device for measuring a number of revolutions of a drive shaft of each of the electric motors and a controller for controlling every electric motor to be driven in a specific number of revolution based on the outputs from the measuring device as well as for actuating every electric motor synchronously with a specific phase delay therebetween, so that the drive means may be protected from being damaged by a possible over loading which might occur when the number of revolutions of each electric motor is varied or the phase thereof is shifted improperly.

Further, since a single electric motor may be used to actuate said plurality of drive means to eliminate any kinds of devices to operate a plurality of electric motors synchronously, the number of controllers and electric motors required for synchronous operation could be reduced, and thus a manufacturing cost could also be reduced.

When a plurality of electric motors are provided for a plurality of drive means so as to correspond one by one with each other, such type of drive means may be employed that comprises: an input shaft rotatably arranged vertically so as to transmit the revolution from an electric motor; a swash plate cam axially attached to said input shaft; and an output shaft which follows displacement caused by the revolution of said swash plate cam to make an elliptical locus. Further, another type of drive means may also be employed which comprises: an input shaft rotatably arranged vertically so as to transmit the revolution from an electric motor; a cam member having a swash plate cam attached thereto by inserting said input shaft therethrough; and an output shaft which is slidably moved on said swash plate cam driven by the revolution of said input shaft to make an elliptical locus by a displacement rotationally moving up and down. Yet further, another type of drive means may also be employed which comprises: an input shaft rotatably arranged obliquely so as to transmit the revolution from an electric motor; an eccentric shaft axially attached to said input shaft; a crank plate for converting a true circular motion of said eccentric shaft to an elliptical motion; and an output shaft axially attached to said crank plate for making an elliptical locus.

On the other hand, in the case where a single electric motor is used to actuate said plurality of drive means, such type of drive means may be employed that comprises: an input shaft rotatably arranged laterally so as to transmit the revolution from an electric motor; an intermediate shaft connected to said input shaft via a universal joint; and an eccentric shaft axially attached to said intermediate shaft.

Furthermore, said separating vessels arranged into multi-rows could enhance a separating ability in comparison with the separating vessel in single-row.

Still further, an apparatus according to the present invention further comprises: a circular dam disposed on a separating plate in a center of said separating vessel and having a unhulled rice discharging port; a shutter for opening or closing said unhulled rice discharging port; and a unit for actuating said shutter; wherein, said unit for actuating said shutter is actuated in response to an output signal from a unhulled rice/unpolished rice detection sensor for distinguishing the unhulled rice and unpolished rice from each other on the separating plates, so that a discharge amount of the unhulled rice could be controlled based on a proportion of the unhulled rice layer to the unpolished rice layer on the cone-shaped separating plates during a period from the beginning of separation throughout the separating operation.

Yet further, since each of said separating plates of said separating vessel is constructed such that an inclination angle thereof is allowed to be regulated respectively and said apparatus further comprises a regulator unit for regulating the inclination angle of said separating plates, the inclination angle or a slope of he separating plate of the separating vessel can be adjusted, so that a thickness of the layer of rice mixture on the separating plates can be controlled appropriately.

Besides, since the apparatus according to the present invention further comprises a level sensor for detecting a level of a layer thickness of rice mixture on said separating plates so that when said level sensor detects the thickness of the layer of said rice mixture being over or under a predetermined level, said regulator unit is actuated to regulate the inclination angle of the separating plates toward a gentle slope direction or a steep slope direction, the rice mixture can be distributed over the separating plates with the level in layer thickness being higher in the central side gradually getting lower toward the peripheral edge side thus to reduce a possible risk that the unhulled rice is discharged by centrifugal force through the unpolished rice discharging port.

DESCRIPTION OF THE PREFERRED EMBODIMENTS

Figure 1:
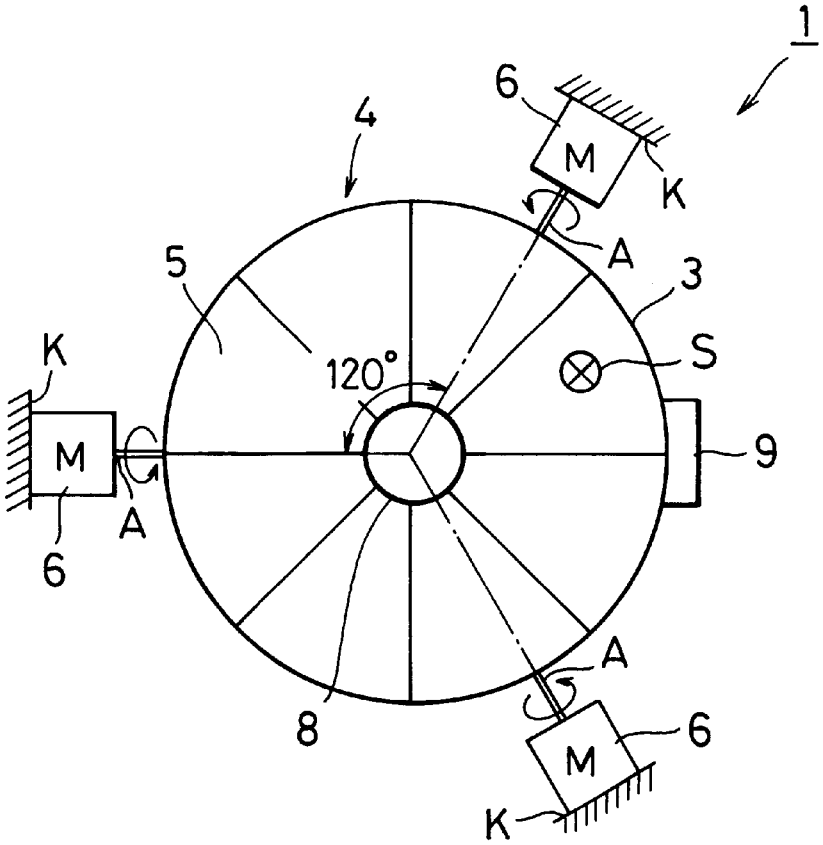
FIG. 1 is a schematic plan view illustrating a rotary shaking separator according to the present invention.
Figure 2:
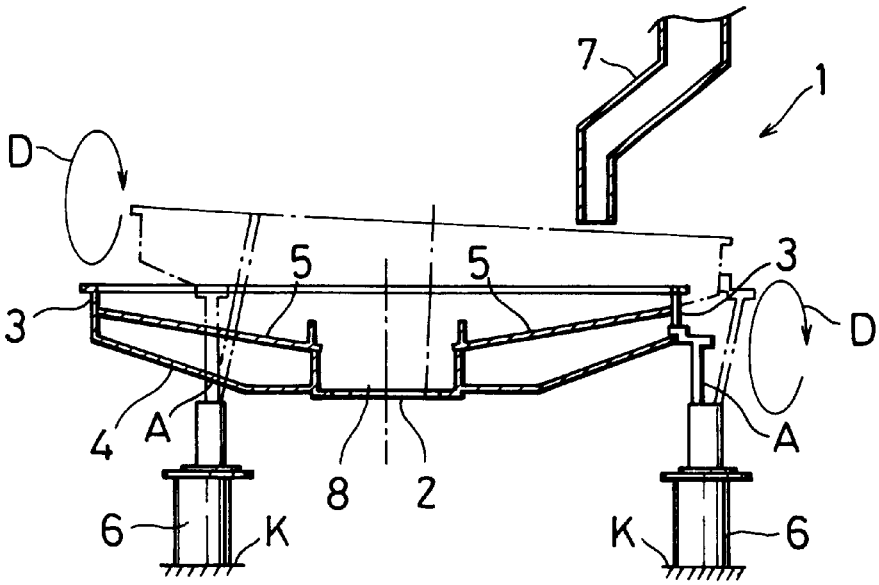
FIG. 2 is a schematic longitudinal cross sectional view illustrating a rotary shaking separator according to the present invention being driven.

An embodiment of the present invention will be described with reference to the attached drawings. Although in the present embodiment the description focuses on a rotary shaking separator for separating mainly grain mixture composed of unhulled rice and unpolished rice into respective groups, it should be appreciated that the present invention is not limited to this application but is applied to any rotary shaking separator which separates and sorts out refined product from extraneous substance, such as oats from foreign matter, rubber from foreign matter, sawdust from foreign matter, buckwheat from buckwheat hull, plastic from foreign matter, and the likes. FIG. 1 is a schematic plan view of a rotary shaking separator according to the present invention while FIG. 2 is a schematic longitudinal cross sectional view, illustrating a rotary shaking separator being driven. Main part of a rotary shaking separator 1 comprises a cone-shaped separating vessel 4 having a central bottom portion 2 formed to be concave and a peripheral edge portion 3 formed to be into higher level, a plurality of segmental separating plates 5 laid within said separating vessel 4 in a shape of circle in plan view, a plurality of drive means 6 for supporting the peripheral edge portion 3 of the separating vessel 4 and for rotationally shaking the separating vessel 4, a supply means 7 for supplying mixture composed of unhulled rice and unpolished rice into a specified location "S" on the segmental separating plates 5, a unhulled rice discharging port 8 for discharging unhulled rice from the central bottom portion 2, and an unpolished rice discharging port 9 for discharging unpolished rice from the peripheral edge portion 3 of the separating vessel 4.

Figure 16:
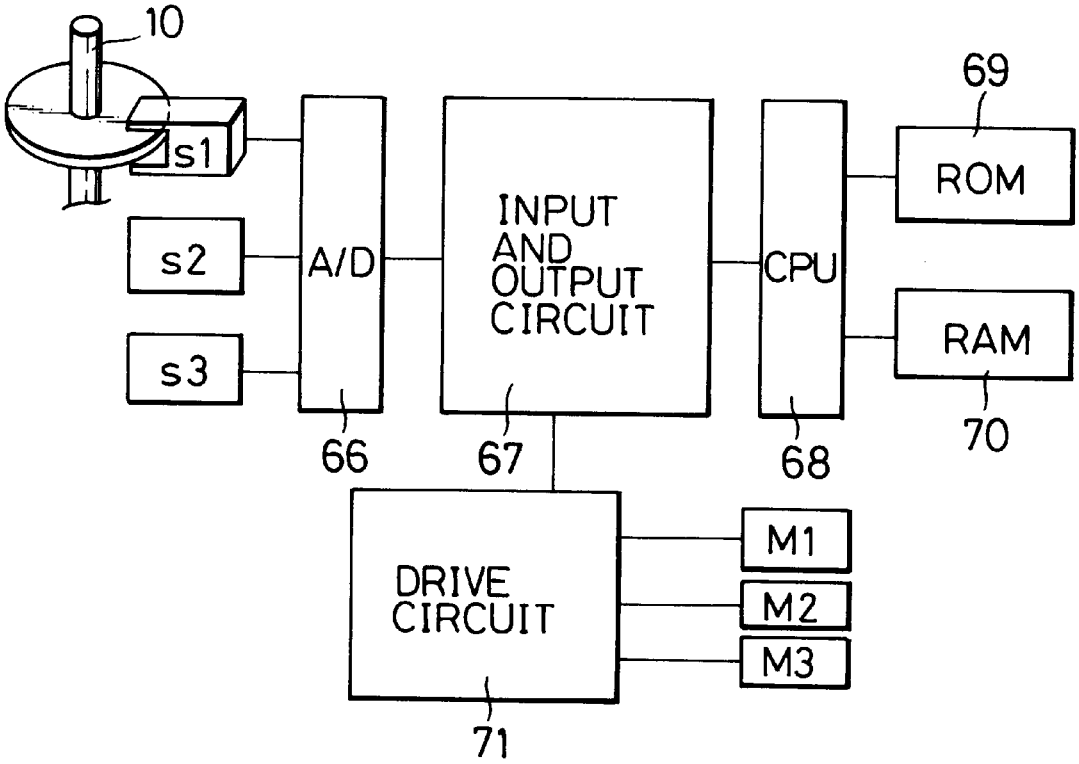
FIG. 16 is a block diagram of a controller for synchronously driving a plurality of electric motors.
Figure 17:
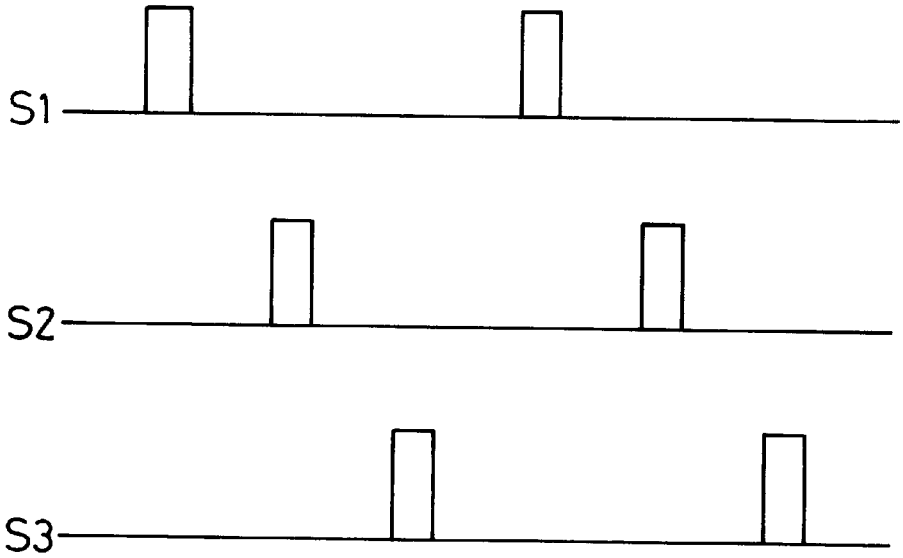
FIG. 17 is a diagram of pulse signals of sensors S1, S2 and S3 for measuring the revolution numbers of rotary shafts of respective motors.

Said drive means 6 is composed of, for example, three pieces of drive means in total, each of the drive means 6 being arranged in each of three sections which are created by dividing the arc of the peripheral edge 3 of the separating vessel 4 by three at every 120° (see FIG. 1). One end of each of the drive means 6 is defined as fixed end "K" to constrain a motion, while the other end thereof is defined as an actuator "A" to support the separating vessel 4 and bring the container into a rotationally shaking motion. Three drive means 6 are correspondingly provided with three electric motors "M" as one to one respectively, and in the case where the three electric motors M1, M2 and M3 are driven synchronously, there may be preferably provided further with a measuring means for measuring the number of revolutions of drive shaft of each of the electric motors M1, M2 and M3 as shown in FIG. 16, and a controller for controlling all of the electric motors to have the predetermined same number of revolutions based on the outputs from said measuring means and also for actuating respective electric motors synchronously with a specified phase delay therebetween. FIG. 17 shows pulse signals of sensors S1, S2 and S3 for respectively measuring the number of revolutions of a rotary shaft of each of the electric motors, and the operation of the electric motor will be described with reference to FIGS. 16 and 17. A signal from each of the sensors S1, S2 and S3 for measuring the number of revolutions of the drive shaft 10 of each motor is analogue-to-digital-converted into a pulse signal as shown in FIG. 17 by an A/D converter 66, which pulse signal in turn is transmitted to a CPU 68 via an input/output circuit 67. A CPU 68 connects with a storage unit composed of a ROM 69 and a RAM 70, in which a predetermined number of motor revolutions, timing of synchronization and the like have been stored. The CPU 68, based on the signal obtained from each of the sensors S1, S2 and S3, controls all of the motors M1, M2 and M3 to have a certain number of revolutions as well as actuates the electric motor M1, M2 and M3 synchronously so that each of them are activated with a phase delayed as shown by a wave form in FIG. 17.

Figure 3:
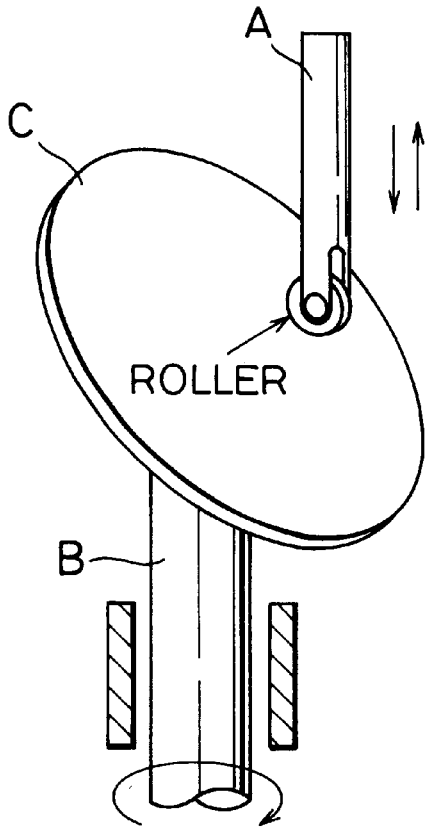
FIG. 3 is a perspective view of a swash plate cam C.

As for a motion of the actuator "A", it is required that the separating vessel 4 is driven to form an elliptical motion "D" (see an arrow "D" in FIG. 2) as viewed from the side thereof. On this purpose, a swash plate cam "C" or the like shown in FIG. 3 may be employed. That is, while the longitudinal shaft "B" as an input shaft side is in its rotating motion, "a roller" is slidably driven by the swash plate cam "C" axially attached to the longitudinal shaft "B" to bring the actuator "A" as an output shaft side into an elliptical motion.

Figure 4:
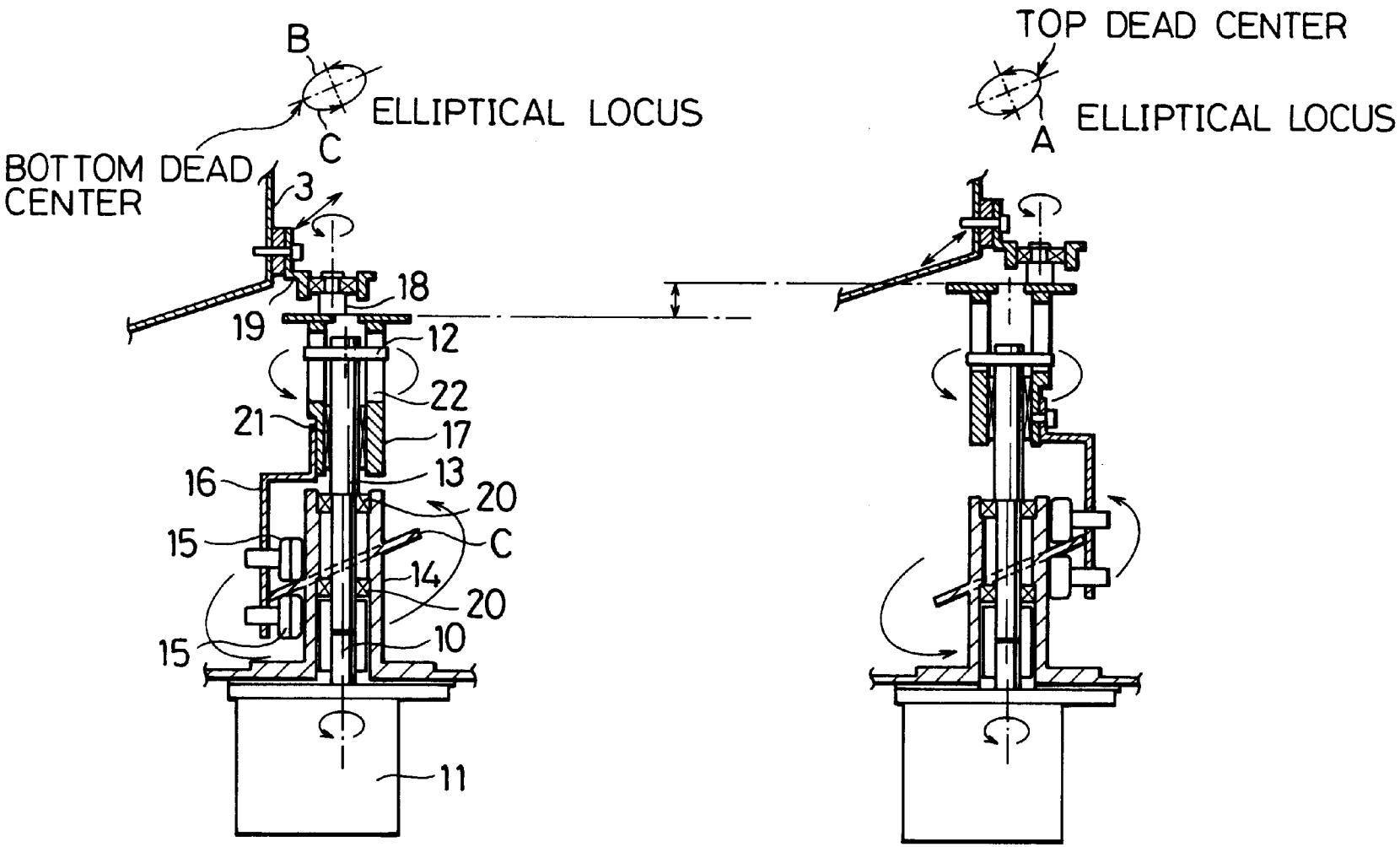
FIG. 4 shows an embodiment of a drive means to which the swash plate cam C is applied.

FIG. 4 shows an embodiment of the drive means 6 to which a swash plate cam "C" is applied. This drive means 6 comprises; a motor 11 having a longitudinal motor shaft rotating as an input shaft side; a rotary shaft 13 axially attached to the motor shaft 10 and having a whirl-stop 12 arranged in an upper portion thereof; a cylindrical cam member 14 through which said rotary shaft 13 is inserted and to which the swash plate cam "C" is attached projecting outwardly therefrom with a certain inclination angle; a pair of rollers 15, 15, which sidably move sandwiching the swash plate cam "C" at an upper and lower surfaces thereof; a support member 16 which moves up and down associated with the motion of said rollers 15, 15; a cylindrical member 17 which is rotationally moved up and down by said support member 16 and said whirl-stop 12; a second rotary shaft 18 arranged on an upper end of said cylindrical member 17 as offset from a center of axis of said rotary shaft 13; and a joint piece 19 for coupling the second rotary shaft 18 to the separating vessel 4. Reference numeral 20 designates a bearing arranged to allow the rotary shaft 13 to rotate within the cam member 14, and reference numeral 21 designates another bearing arranged to allow the cylindrical member 17 to be rotationally moved up and down around the rotary shaft 13. Further, reference numeral 22 designates an elongated hole disposed in the cylindrical member 17, through which the whirl-stop 12 of the rotary shaft 13 is inserted.

An operation of a mechanism of the configuration explained above will be described. The drive means 6 in the present invention, as shown in FIG. 1, is composed of three pieces of drive means in total, each of the drive means being disposed in each one of the sections which are defined by dividing the arc of peripheral edge portion 3 of the separating vessel 4 by three at every 120°. Each of the three drive means 6 is sequentially driven in a different cycle thus to rotationally shake the separating vessel 4 as a whole. FIG. 4 also shows "which location on the elliptical locus shown in FIG. 2, each one of those three drive means is positioned in", wherein a phase is shifted at the point "A", point "B" and point "C" on the elliptical locus and the each one of three drive means 6 is respectively driven at each point to cause the separating vessel 4 to be rotationally shaken.

Then, when the motor 11 in FIG. 4 is rotated, the longitudinal motor shaft 10 is rotated followed by the rotation of the rotary shaft 13. When the rotary shaft 13 is rotated, the cylindrical member 17 is rotated by the whirl-stop 12 attached to the upper portion of the rotary shaft 13, and in turn the support member 16 fixedly attached to the cylindrical member 17 is also rotated. Then, when a pair of rollers 15, 15 attached to the lower end of the support member 16 sidably moves around the cam member 14 upwardly as sandwiching the swash plate cam "C" at the upper and lower surfaces thereof, the cylindrical member 17 is gradually moved upward with respect to the rotary shaft 13. On the other hand, when the pair of rollers 15, 15 passes over the upper dead point to sidably move around the cam member 14 downwardly, the cylindrical member 17 is gradually moved down with respect to the rotary shaft 13. The separating vessel 4 is connected to the cylindrical member 17 via the second rotary shaft 18 and the joint piece 19, so that a motion of the separating vessel 4 is not strictly limited but the separating vessel 4 is allowed to move freely to a certain extent.

The locus of the separating vessel 4 made by said drive means 6 inevitably becomes an elliptical locus when taking the motions in a horizontal direction and a vertical direction and also an inclined surface of the swash plate cam "C" into account, wherein a stroke in the horizontal direction defines a longitudinal axis of the ellipse and a stroke in the vertical direction defines a lateral axis of the ellipse. This means that the separating vessel is rotationally shaken at three locations in the peripheral edge portion thereof in order. That is, when one of the three drive means 6 disposed respectively in one of the three locations on the peripheral edge portion of the separating vessel is currently in point "A" on the elliptical locus, the other two of the drive means 6 disposed in the other locations are either in point "B" or point "C" respectively, thus to rotationally shake the separating vessel in sequence.

Since rice mixture composed of unhulled rice and unpolished rice supplied into the separating vessel 4 (see FIG. 1) has an acceleration getting greater toward the vicinity of the peripheral edge portion 3 and further the circular separating plate 5 is arranged as inclined upward toward the peripheral edge portion 3, the unpolished rice having smaller grain size and higher specific gravity is carried toward the peripheral edge portion to be discharged from the unpolished rice discharging port 9, while the unhulled rice having greater grain size and lower specific gravity slides down on the cone-shaped separating plate 5 to be discharged through the unhulled rice discharging port 8.

The configuration described above eliminates a failure in separation which otherwise possibly occurs on the same separating vessel 4, and makes it possible to maintain separating accuracy at a certain level as well as to provide an rotary shaking separator which requires no rotary shaft inserted through the central portion of the separating vessel 4.

Figure 9:
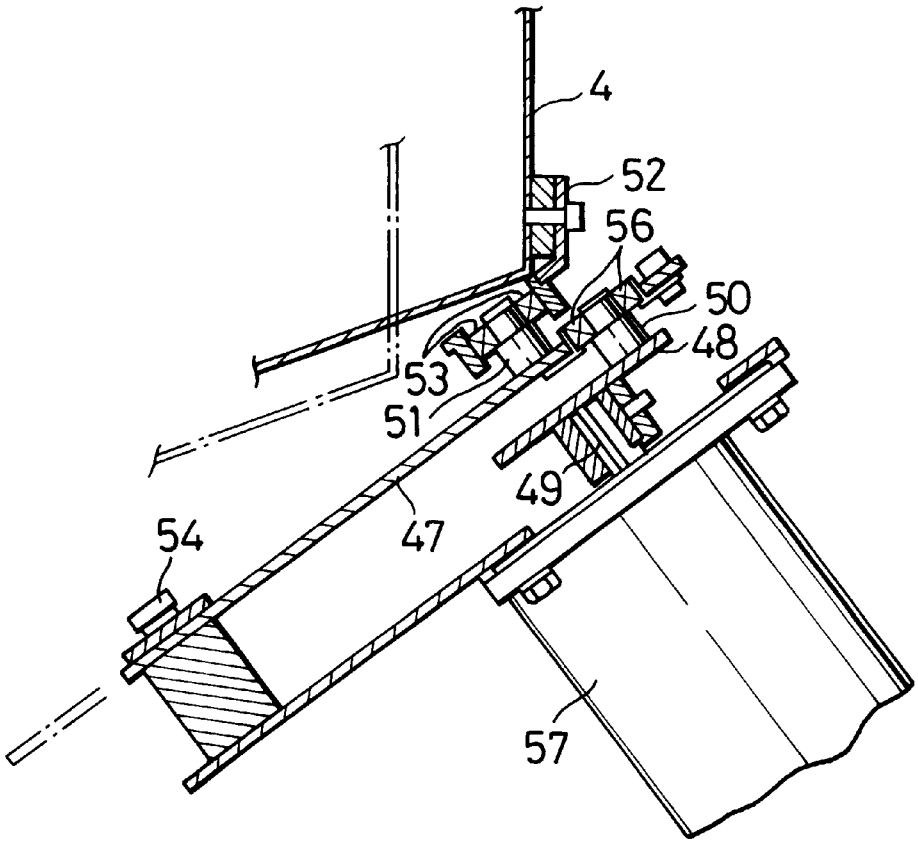
FIG. 9 is a schematic longitudinal cross sectional view illustrating an alternative embodiment of the drive means.
Figure 10:
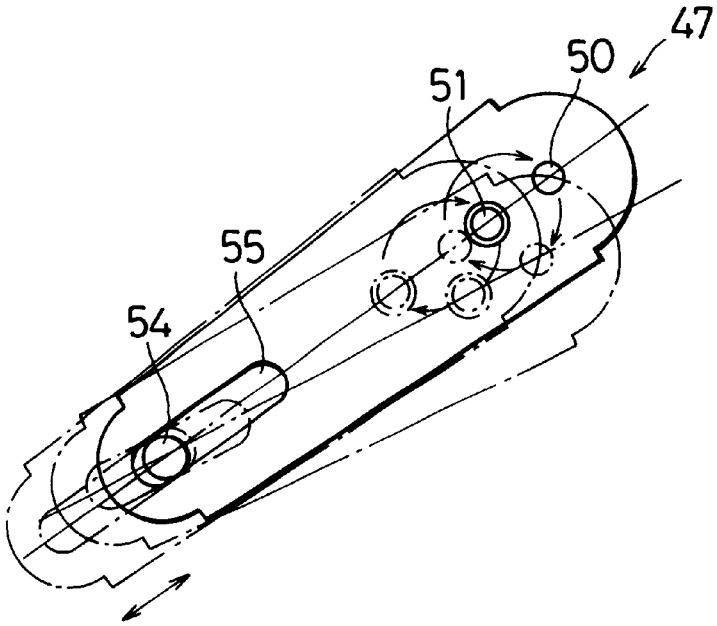
FIG. 10 is an enlarged view of a crank plate.

FIG. 9 is a schematic longitudinal cross sectional view of another embodiment. FIG. 9 shows the embodiment in which a separating vessel 4 is supported from under side along a diagonal direction in side view by a drive means at a nose portion thereof to give an elliptical motion to the sep arating vessel 4. In the case where the separating vessel 4 is supported from under side along the diagonal direction, preferably the separating vessel 4 is supported by an eccentric shaft 50 via a crank plate 47 as shown in FIG. 10. Reference numeral 48 designates a rotary plate for connecting a motor shaft 49 with the eccentric shaft 50, and reference numeral 51 designates an eccentric shaft which is driven by the crank plate 47 to make an elliptical motion, said eccentric shaft 51 being fixedly attached to the separating vessel 4 via a fixing bracket 52. Reference numeral 53 designates a bearing which rotatably supports the eccentric shaft 51.

The crank plate 47 shown in FIGS. 9 and 10 has: an elongated hole 55 formed in a lower portion thereof, through which a supporting shaft 54 is inserted to make a supporting point of up and down motion; a bearing 56 disposed in an upper portion thereof for receiving the eccentric shaft 50; and the eccentric shaft 51 attached thereto at a middle portion thereof, which protrudes therefrom and makes an elliptical motion. As the motor shaft 49 of a gear motor 57 rotates, the elliptical plate 47 moves from a position indicated by a solid line to another position indicated by an alternate long and short dash line (see FIG. 10) thus to allow the separating vessel 4 to move elliptically in side view. As similar to the above description, the same effect may be obtained from the other two drive means, when a phase of the each eccentric shaft of these drive means is shifted by every 120°. The configuration described above eliminates a failure in separation which otherwise possibly occurs on the same separating vessel 4, and makes it possible to maintain separating accuracy at a certain level as well as to provide an rotary shaking separator which requires no rotary shaft inserted through the central portion of the separating vessel 4.

Figure 5:
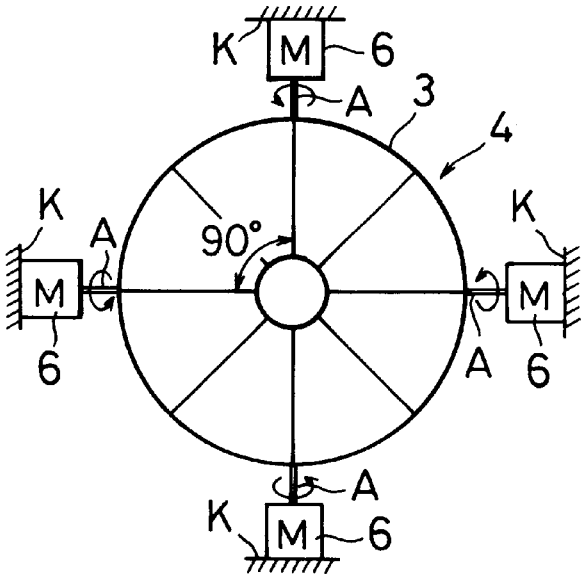
FIG. 5 is a schematic plan view illustrating an alternative embodiment of the drive means.

An alternative embodiment of the drive means 6 shown in FIG. 5, comprises four drive means in total, each one of the four drive means 6 being disposed in each one of four locations which are defined by dividing a peripheral edge portion 3 of a separating vessel 4 by four at every 90°. Each of the four drive means 6, as similar to that shown in FIG. 1, has one end fixedly attached to a machine frame and the other end served as an actuator "A" for supporting the separating vessel 4 to bring it into a rotationally shaking motion.

Figure 6:
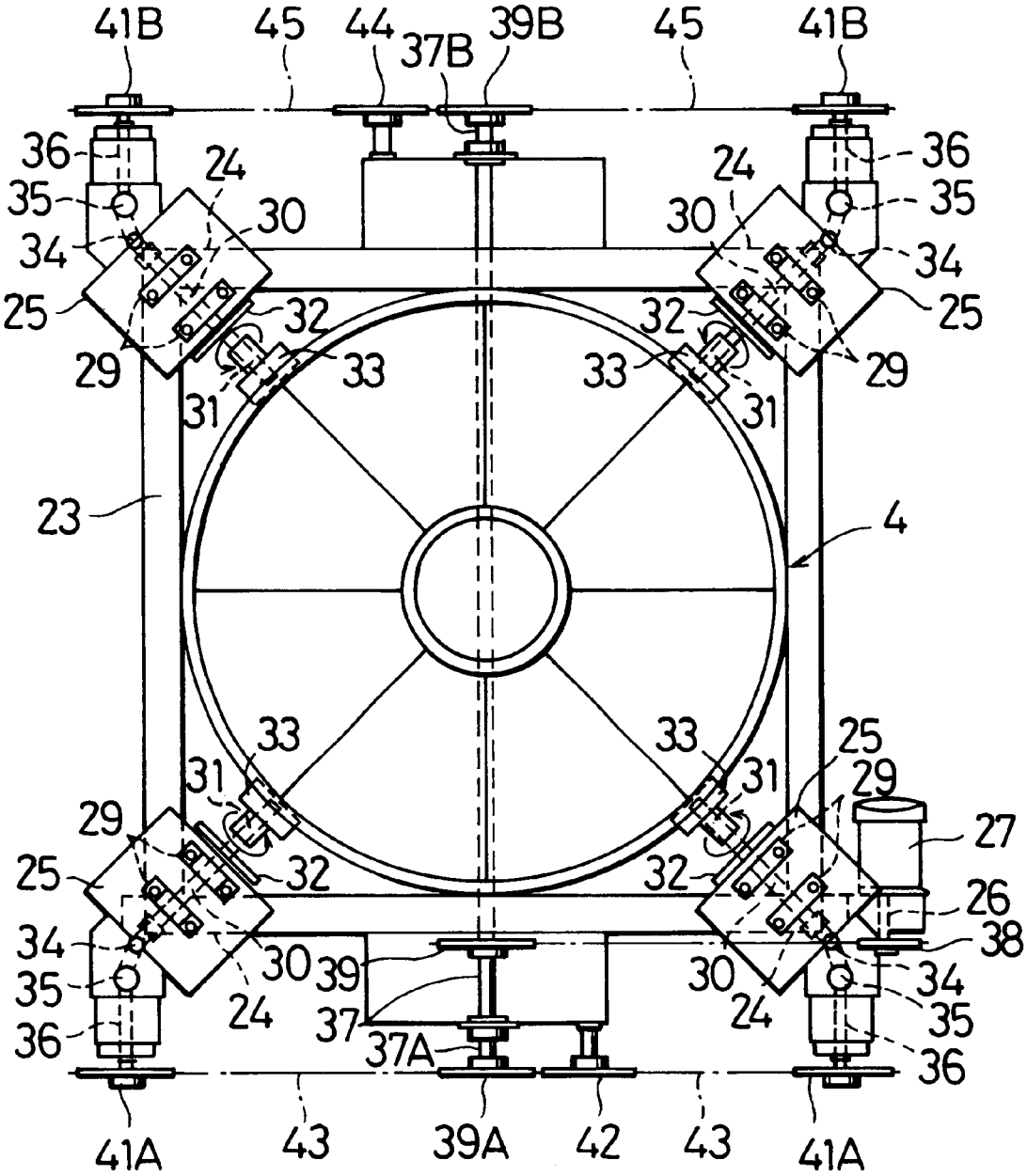
FIG. 6 is a schematic plan view of a configuration in which four actuators "A" are operated by a single motor shaft.

Although the embodiment of the drive means shown in FIG. 5 comprises four units of drive means 6 in total, an application is not limited to this but one motor shaft may be used to actuate all of four units of actuators "A". FIG. 6 is a schematic plane view illustrating an embodiment which employs one motor shaft to actuate all of four units of actuators "A", and FIG. 7 is a schematic side elevation view of FIG. 6 viewed from the motor shaft side.

Figure 7:
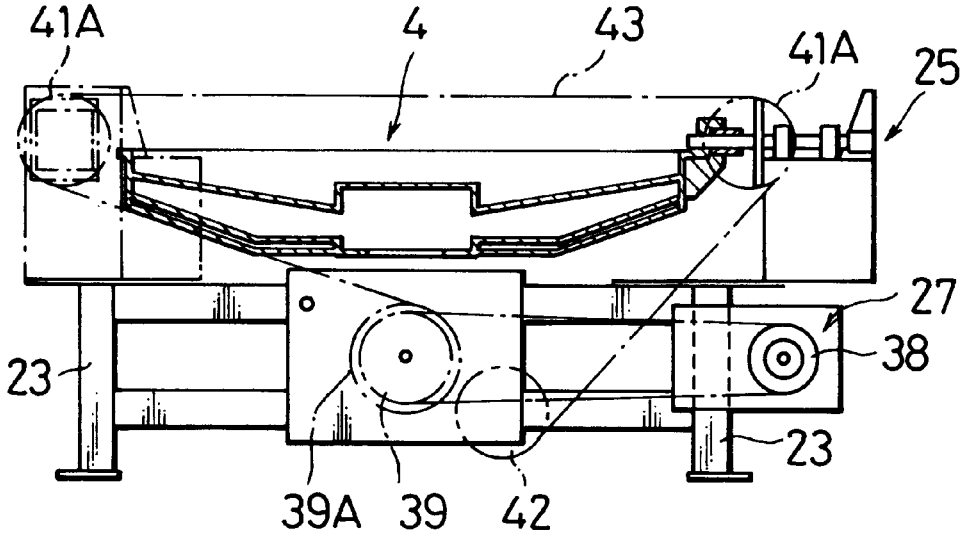
FIG. 7 is a schematic side elevation view of the configuration of FIG. 6, viewed from the motor shaft side.

In FIGS. 6 and 7, a square machine frame 23 has four support members 25 each being fixedly attached to an upper portion of each of four corner portions 24 thereof respectively for supporting the circular separating vessel 4, and a single motor 27 having a motor shaft 26 is fixedly mounted to a leg portion 28 of the machine frame 23. To explain the relationship between the circular separating vessel 4 and the four support members 25, a following description focuses on one of the support members 25. A rotary shaft 30 supported by a bearing 29 in the support member 25 and an eccentric shaft 31 offset from the center of said rotary shaft 30, are connected to each other by a rotary plate 32, wherein the eccentric shaft 31 extending from said rotary plate 32 is inserted through an eccentric bearing 33 fixedly attached to the separating vessel 4 so as to support and eccentrically shake the separating vessel 4. Further, each of the rotary shafts 30 is coupled with an intermediate shaft 36 via two universal joints 34 and 35 so as to transmit a revolution even when the rotary shaft 30 and the intermediate shaft 36 are not aligned but crossed.

A mechanism for transmitting an output from the single motor shaft 26 to the intermediate shafts 36 will now be described. Initially, the revolution from the motor shaft 26 is transmitted to an elongated central shaft 37 rotatably disposed laterally in a central portion of the machine frame 23, which allows two outputs to be taken out from one end side 37A and the other end side 37B respectively, and then each of these two outputs is transmitted to two intermediate shafts 36 respectively thus to transmit the revolution to four intermediate shafts 36 in total. A revolution is transmitted via a chain 40 from a sprocket 38 axially attached to the motor shaft 26 to another sprocket 39 axially attached to the central shaft 37, and then the revolution is transmitted via a chain 43 associated with an idle sprocket 42 from a sprocket 39A axially attached to the one end side of the central shaft 37 to two sprockets 41A, 41A axially attached to two intermediate shafts 36, 36 respectively. Similarly, the revolution is transmitted via a chain 45 associated with an idle sprocket 44 from a sprocket 39B axially attached to the other side of the central shaft 37 to the other two sprockets 41B, 41B axially attached to the other two intermediate shafts 36, 36, respectively.

Figure 8:
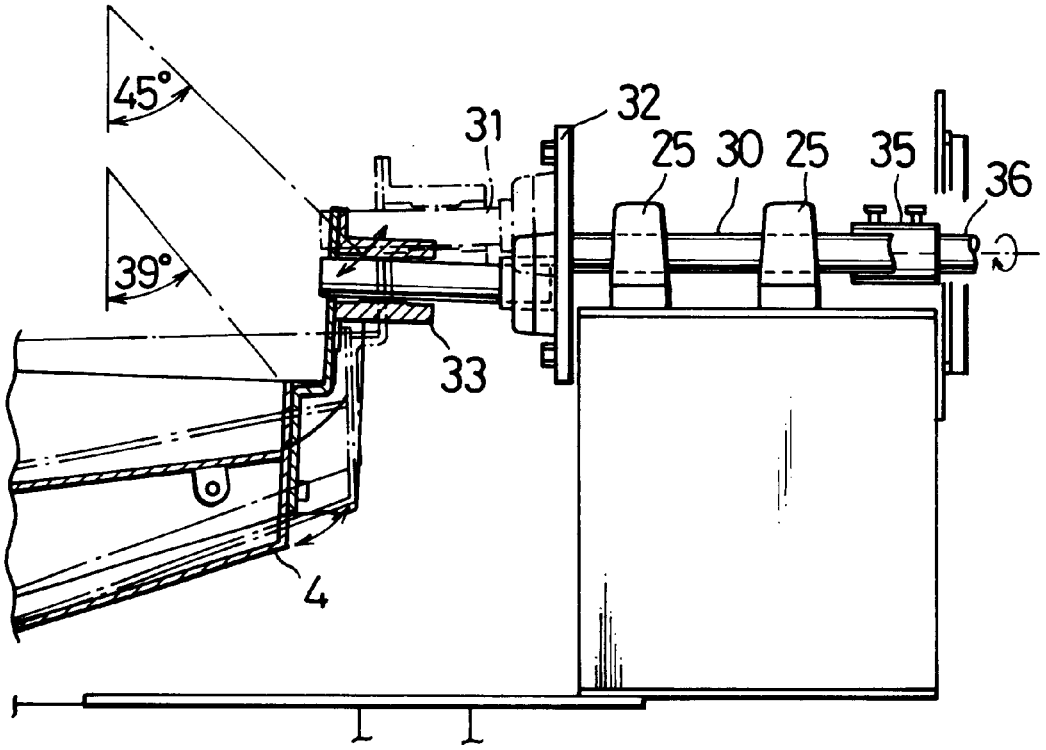
FIG. 8 is an enlarged view illustrating a connection of a support member with a separating vessel.

An operation of a mechanism of the configuration described above will now be described with reference to FIG. 8. FIG. 8 is an enlarged view illustrating a connection between the support member and the separating vessel, wherein when the revolution from the motor shaft 26 is transmitted to the intermediate shaft 36 through a mechanism of the above configuration, the revolution is in turn transmitted through the universal joint 35 to the rotary shaft 30 in the support member 25. Since the rotary shaft 30 is supported by the support member 25, it can drive to rotate the rotary plate 32 at the center thereof without vibrating. On the other side of the rotary plate 32, the eccentric shaft 31 is attached via a joint 46 so as to protrude at a position offset from the center of the rotary plate 32 so that a front end portion of the eccentric shaft 31 is inserted through the eccentric bearing 33 fixedly attached to the separating vessel 4 and thereby the separating vessel 4 may be rotationally shaken. The separating vessel 4 in FIG. 8 is eccentrically shaken from a position indicated by a solid line to another position indicated by an alternate long and short dash line, wherein a position in a lower dead point is at 36°, while a position in an upper dead point is at 45° and the displacement caused by the eccentric shake is 6°.

Although the effect is described with reference to one of the support member in FIG. 8, the same effect is obtained from each one of the other three support members when the phase of the eccentric shaft is shifted by every 90°. The configuration as described above eliminates any failure in separation which otherwise possibly occurs on the same separating vessel 4, and makes it possible to maintain separating accuracy at a certain level as well as to provide a rotary shaking separator which requires no rotary shaft inserted through the central ortion of the separating vessel 4.

Figure 11:
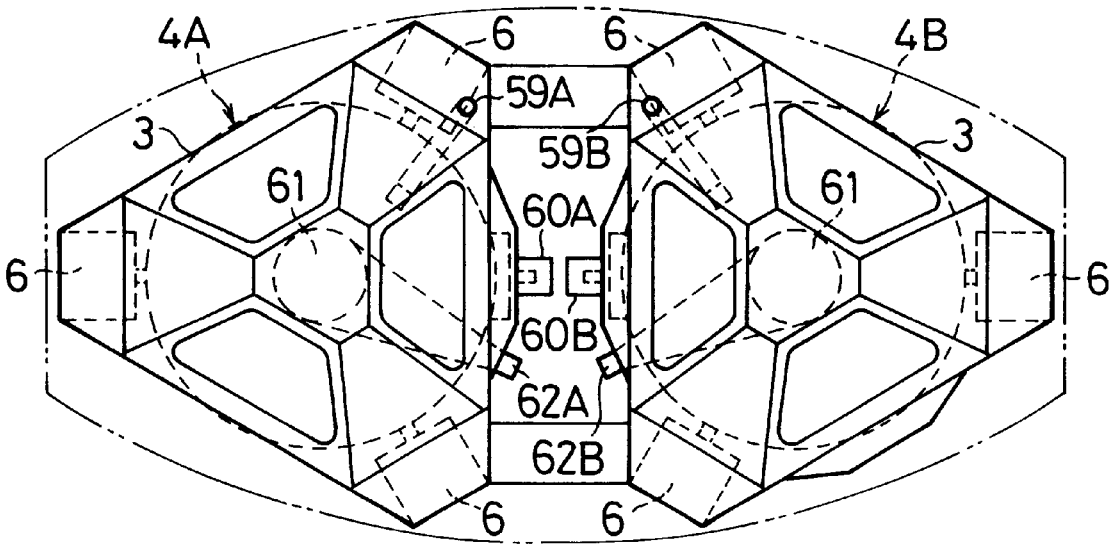
FIG. 11 is a schematic plan view of a multi-row model of the rotary shaking separator.
Figure 12:
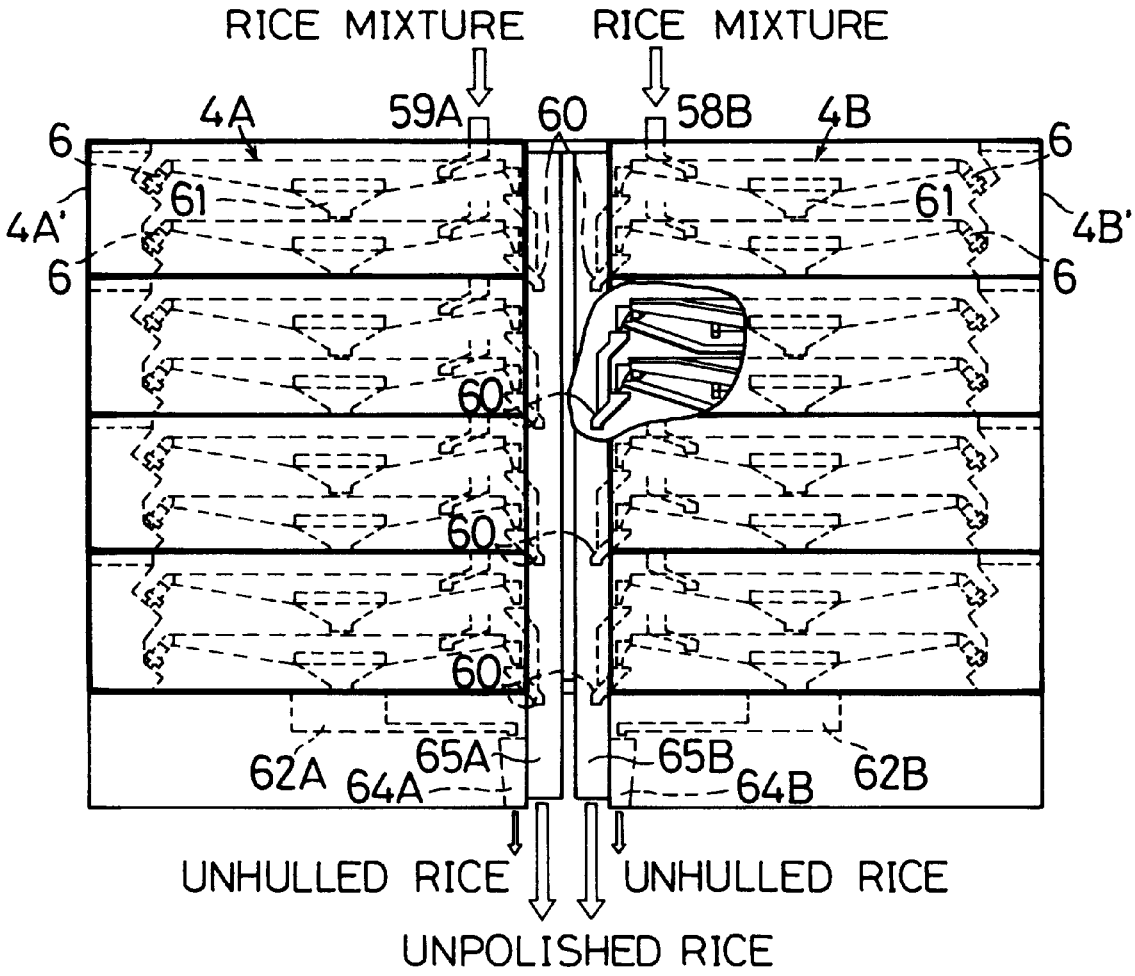
FIG. 12 is a schematic cross sectional side elevation view of a multi-row model of the rotary shaking separator.
Figure 13:
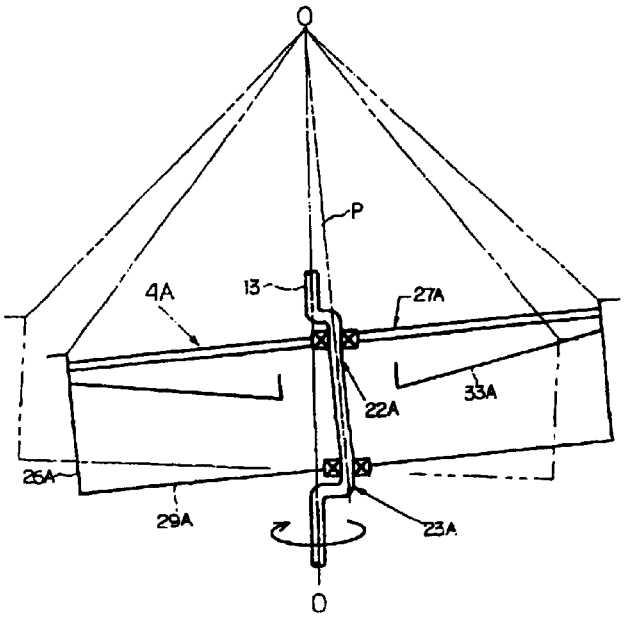
FIG. 13 PRIOR ART
FIG. 13 is a schematic view of configuration of a rotary shaking separator according to the prior art.
Figure 14:
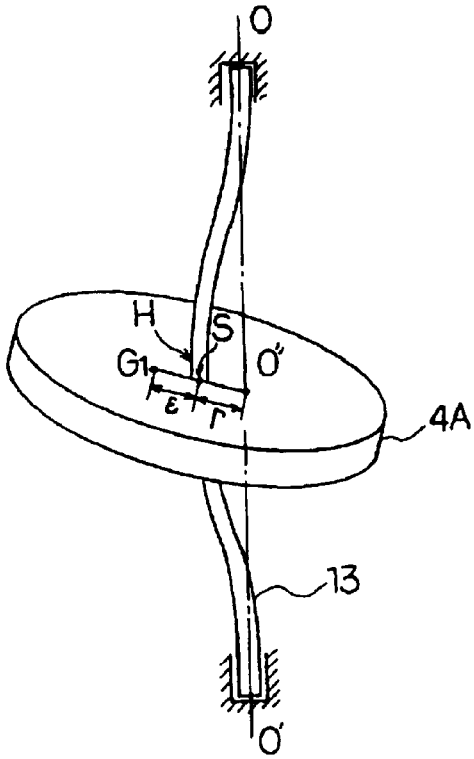
FIG. 14 PRIOR ART
FIG. 14 is a schematic view of the rotary shaking separator according to the prior art, illustrating a selecting frame 4A being rotated by an eccentric rotary shaft 13.
Figure 15:
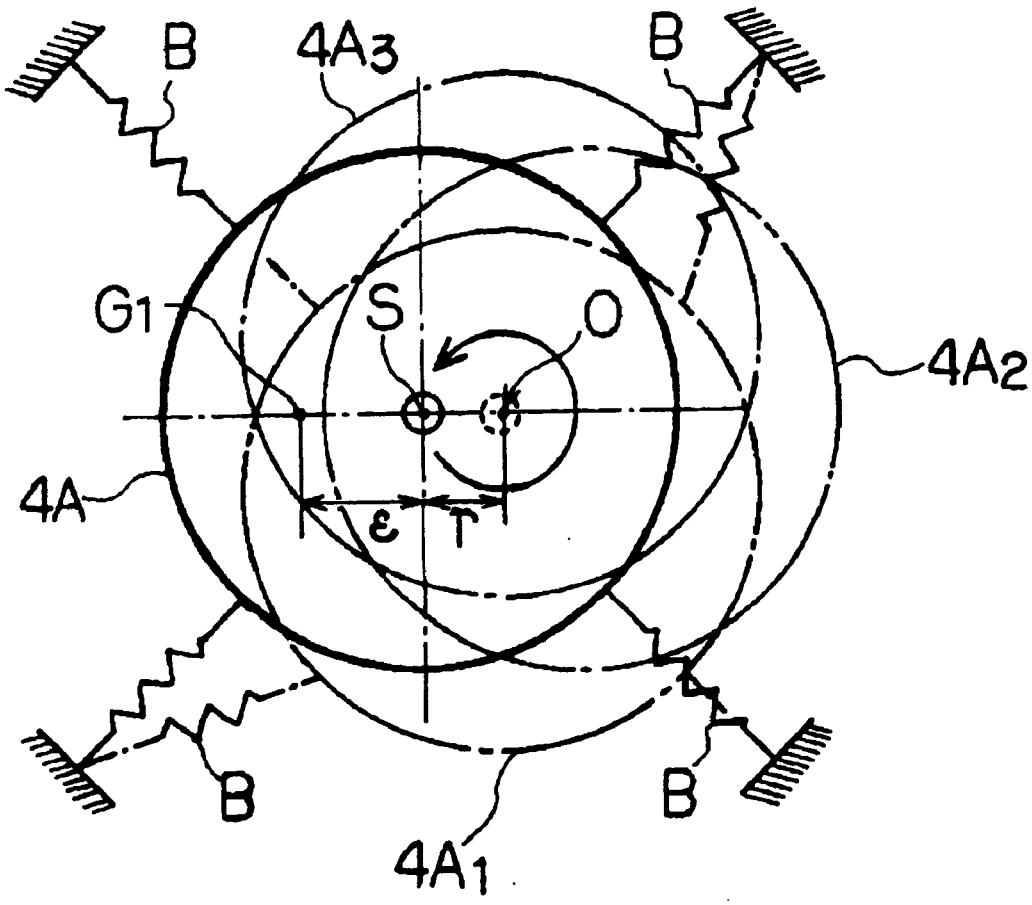
FIG. 15 PRIOR ART
FIG. 15 is a schematic top view of the selecting frame 4A in the rotary shaking separator according to the prior art.

FIGS. 11 and 12 show a multi-row model of a rotary shaking separator which requires no rotary shaft inserted through the central portion of the separating vessels 4, wherein referring to the schematic plan view of FIG. 11, a peripheral edge portion 3 of each of the separating vessels 4 is supported at three locations, so that the separating vessel 4 is rotationally shaken by the drive means 6 disposed at said three locations. In this model, two separating vessels 4A and 4B are arranged opposite to each other, and material supply pipes 59A, 59B or means for supplying material to each of the two separating vessels 4A, 4B and unpolished rice discharging gutters 60A, 60B for discharging separated unpolished rice from each of the two separating vessels 4A, 4B are respectively disposed in the middle portion between those containers 4A, 4B.

FIG. 12 is a schematic longitudinal cross sectional view of the multi-row model. Referring to FIG. 12, numbers of unpolished rice discharging gutters 60 are arranged in the middle portion between a ridge of the separating vessels 4A and another ridge of the separating vessels 4B to discharge the unpolished rice through an unpolished rice discharging cylinder 65 disposed in a central portion of a machine frame 64 to outside of the machine. A circular unhulled rice discharging portion 61 is formed in the central portion of each separating vessel 4, and only the unhulled rice discharging portion 61 located at the lowest level is exclusively coupled with one end side of corresponding unhulled rice discharging gutter 62A or 62B, while the other end sides of the unhulled rice discharging gutters 62A and 62B are couples with a unhulled rice discharging cylinder 64 disposed in the center of the machine frame 63 to discharge the unhulled lice to outside of the machine.

In the configuration shown in FIG. 12, two containers composed of the upper eparating vessel and the lower container are formed into one unit referred to as 4A' or 4B', and four sets of the unit 4A' and another four sets of the unit 4' are piled up with a unpolished rice discharging cylinder 65 introduced through the middle portion therebetween.

In the above configuration, when the drive means 6 is driven, each separating vessel 4 is rotationally shaken by the torque of the drive means. As a matter of course, multi-row model having the configuration described above can enhance a separating ability in comparison with a single-row case, while this configuration eliminates any failure in separation which otherwise possibly occurs on the same separating vessel 4, and makes it possible to retain a certain level of separating accuracy as well as to provide an rotary shaking separator which requires no rotary shaft inserted through the central portion of the separating vessel 4.

Figure 20:
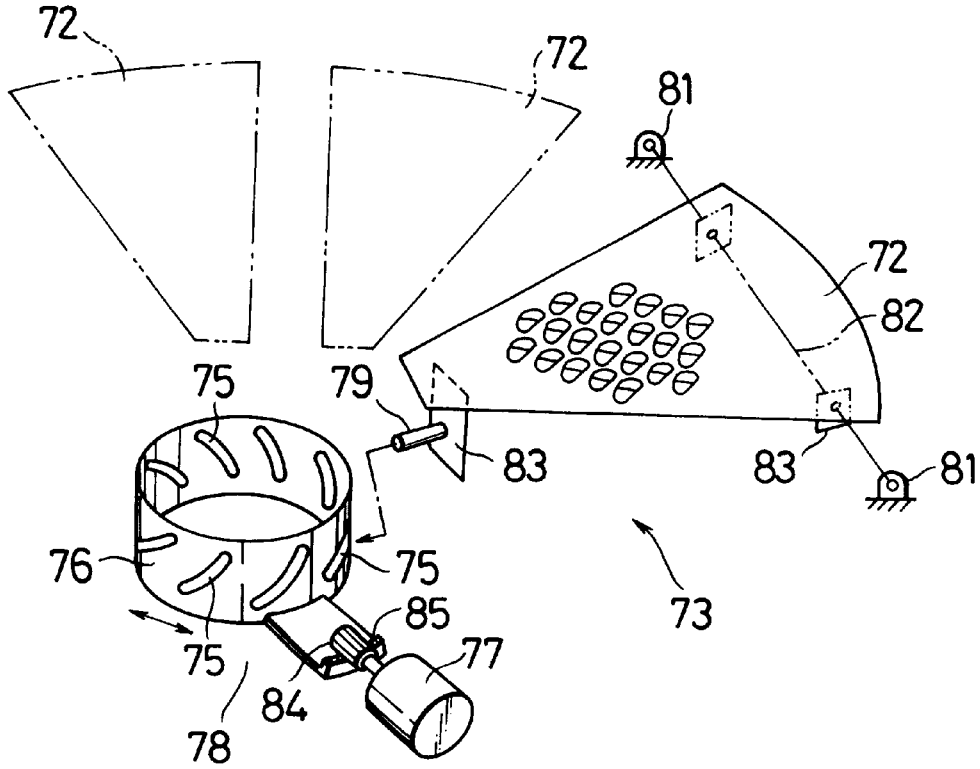
FIG. 20 is a perspective view of a mechanism for regulating an inclination angle of separating plates.

A regulator unit for regulating an inclination angle of a plurality of separating plates within each of the separating vessels 4 will now be described. As obviously seen from FIGS. 18 and 20, the segmental separating plates 72 are arranged in a cone-shaped form inside the separating vessel 4. The adjacent separating plates 72, 72 overlap one over another at side edges thereof. A regulator unit 73 for regulating an inclination angle of the separating plates 72 is disposed beneath the separating plate 72 within the separating vessel 4. Said regulator unit 73 comprises: a cylindrical cam 76 attached to a bottom portion 74 of the separating vessel and having a plurality of oblique cam slots 75; a rotary drive unit 78 for rotating said cylindrical cam 76, which includes a reversible motor 77; and a support frames 83 having in one end a pin 79 engaged with the cam slot 75 of the cylindrical cam 76, having the other end rotatably coupled via a pin 82 to a bracket 81 fixedly attached to a side-wall 80 of the separating vessel 4, and supporting the segmental separating plate 4 from under side. As can be seen most obviously in FIG. 20, the rotary drive unit 78 includes a pinion 84 arranged on an output shaft of the reversible motor 77 and a sector-shaped rack 85 attached to the cylindrical cam 76 and engaged with the pinion 84, wherein the revolution of the motor causes the pin 79 to be moved along the oblique cam slot 75, which in turn swings each separating plate 72 around the rotational coupling pin 82, and thereby a slope of the separating plate 72 may be regulated to a desired angle, for example, from 8° to 12°.

Figure 21:
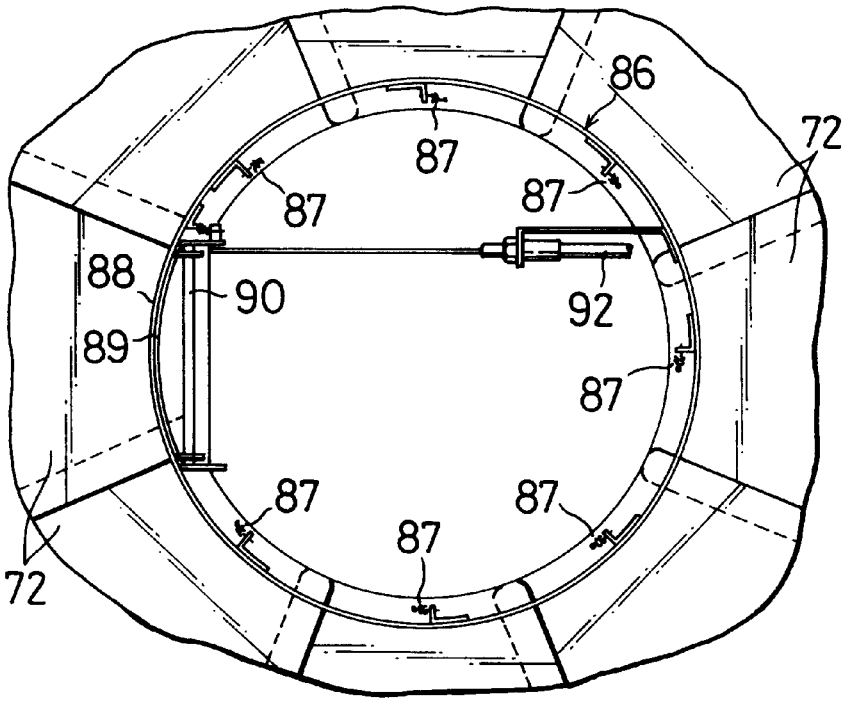
FIG. 21 is a plan view of a circular dam arranged on the separating plates.
Figure 22:
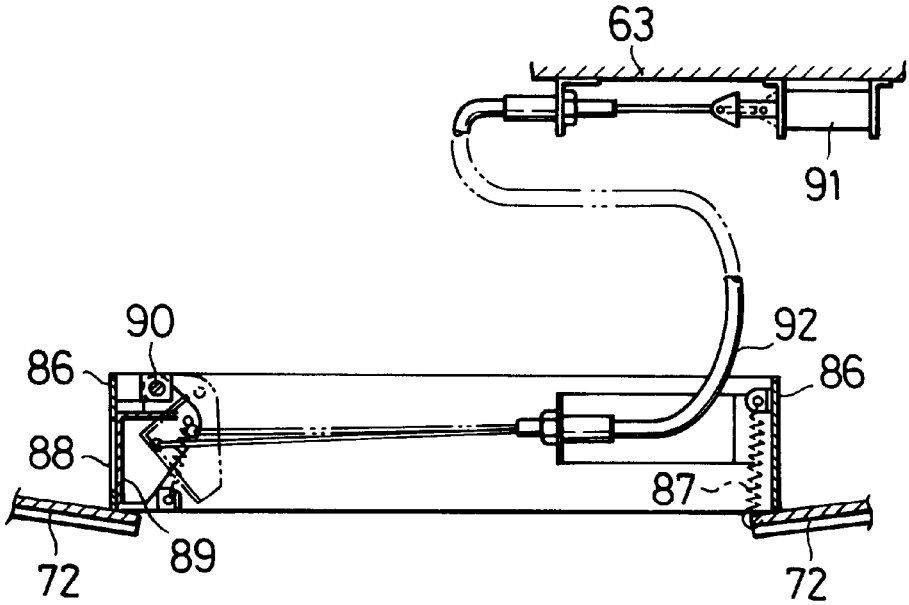
FIG. 22 is a longitudinal cross sectional view of FIG. 21.

Then, the circular dam arranged on the separating plates to form the unhulled rice discharging portion will be described. Referring to FIGS. 21 and 22, a relationship between the separating plates 72 of the separating vessel 4 and the circular dam 86 are shown in detail. The circular dam 86 is mounted on the separating plates 72, and a plurality of springs 87 is disposed between the circular dam 86 and the separating plates 72 for coupling them. Thus, the dam 86 is moved up or down in response to the regulated inclination angle of the separating plates 72, thereby preventing a gap from being created between the separating plates 72 and the dam 86. The circular dam 86 has an opening of unhulled rice discharging port 88 and a shutter for opening or closing said unhulled rice discharging port 88 is rotatably attached to the dam 86 with a shaft 90. A solenoid 91 served as an actuator is fixedly mounted to the machine frame and is connected to the shutter 89 via a cable 92 to open or close the shutter 89 by the operation of the solenoid 91. Although the explanation focuses on a solenoid to be used for an actuator, it should be easily recognized that an air cylinder might be used.

A unhulled rice/unpolished rice detection sensor will now be described with reference to FIG. 23. Above the segmental separating plate 72 of the separating vessel 4 is provided a unhulled rice/unpolished rice detection sensor 93, which radiates light against the unhulled rice and unpolished rice on the separating plate 72 and receives reflected light to determine whether they are unhulled rice or unpolished rice based on a difference in amount of the reflected light. Thus, the unhulled lice/unpolished rice detection sensor 93 determines a boundary between unhulled rice area and unpolished rice area. The unhulled rice/unpolished rice detection sensor 93 is preferably located on the line extending from the unhulled rice discharging port 88 of the dam 86 radially toward the side-wall of the separating vessel and as well on the boundary between the unhulled rice area and the unpolished rice area somehow closer to the center of the container.

Figure 23:
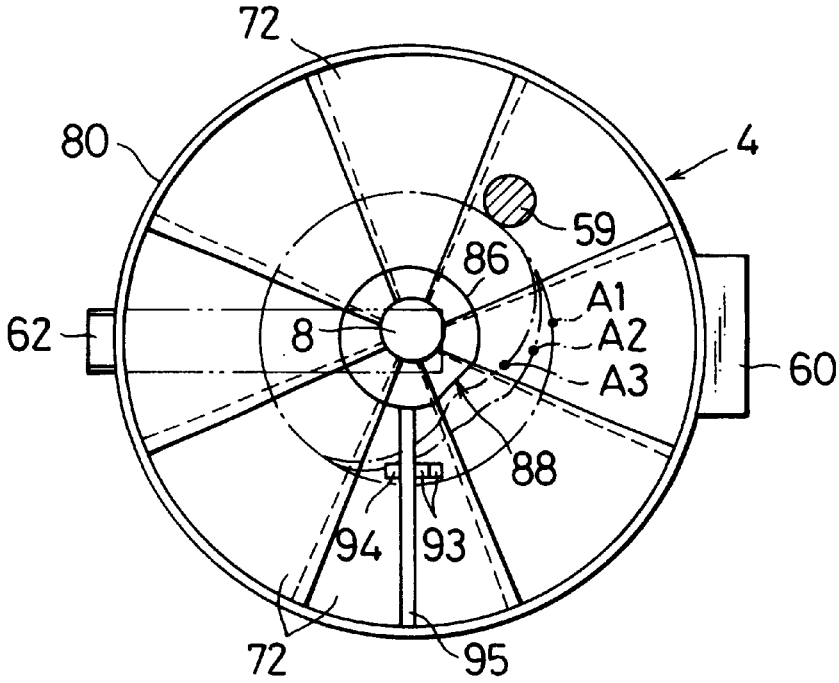
FIG. 23 is a plan view of a separating vessel equipped with a unhulled rice/unpolished rice detection sensor and a level sensor.

Immediate after the beginning of separating operation, when the thickness of rice mixture are getting steady as time goes by, the boundary between the unhulled rice area and the unpolished rice area would be obviously created as shown by reference Al in FIG. 23. At that time, as the unhulled rice/unpolished rice detection sensor 93 determines that the unhulled rice layer exists and sends an ON-signal, the solenoid 91 responsive to the signal is biased through a timer (not shown) set to a certain time period, for example, within the range of 0.5 to 1.5 second to open the shutter 89. Thereby, the unhulled rice are discharged rapidly from the unhulled rice discharging port 88 and the boundary between the unhulled rice area and the unpolished rice area moves to be formed gradually into concave shape as sequentially indicated by the references A1, A2 and A3. After that, when the timer is turned off and the solenoid 91 is released, the shutter 89 closes the unhulled rice discharging port. Then again, a width of the unhulled rice layer increases and the boundary returns from the level indicated by reference A3 through the reference A2 back to the reference A1 in a few seconds. The unhulled rice/unpolished rice detection sensor 93 again detects the unhulled rice layer, and the solenoid 91 is biased to open the shutter 89 for a predetermined period. Thus, when the region of unhulled rice layer moves up to a specified location, the unhulled rice which have been dammed are discharged, and when the region of unhulled rice layer retracts away from a specified level, the discharge of the unhulled rice is stopped. Accordingly, for the period from the beginning of separation throughout the separating operation, an amount of unhulled rice to be discharged is controlled based on the ratio of the unhulled rice layer to the unpolished rice layer on the cone-shaped separating plate. It is of course contemplated that the solenoid may be biased by turning on the manual switch (not shown) to open the shutter and discharge the unhulled lice from the discharging port 88.

In the operation of separating the unhulled rice and the unpolished rice in the rice mixture from each other, if physical properties, such as water contents, friction coefficient or the likes of the rice mixture remain as constant, the separating ability would not be changed, but in the case of separating the unhulled rice and the unpolished rice in the rice mixture from each other having different physical properties (such as water contents or friction coefficient), the thickness of layer of the rice mixture on the separating plates would be varied and eventually the separating ability would also be influenced. According to the present invention, the amount of supplied rice mixture and the number of revolutions of the separating vessel are kept in predetermined values, while the inclination angle or the slope of the separating plate of a separating vessel can be regulated in response to the variation in thickness of the layer, thereby allowing to retain the thickness of the layer in an appropriate level.

Figure 18:
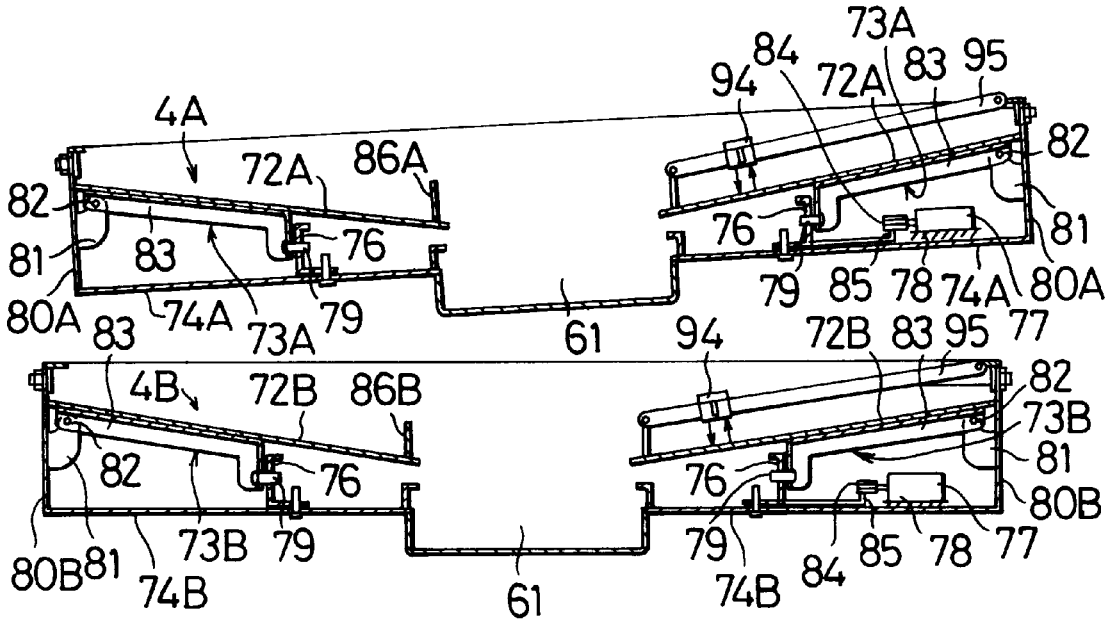
FIG. 18 is a longitudinal cross sectional view illustrating internal components of a separating vessel.
Figure 19:
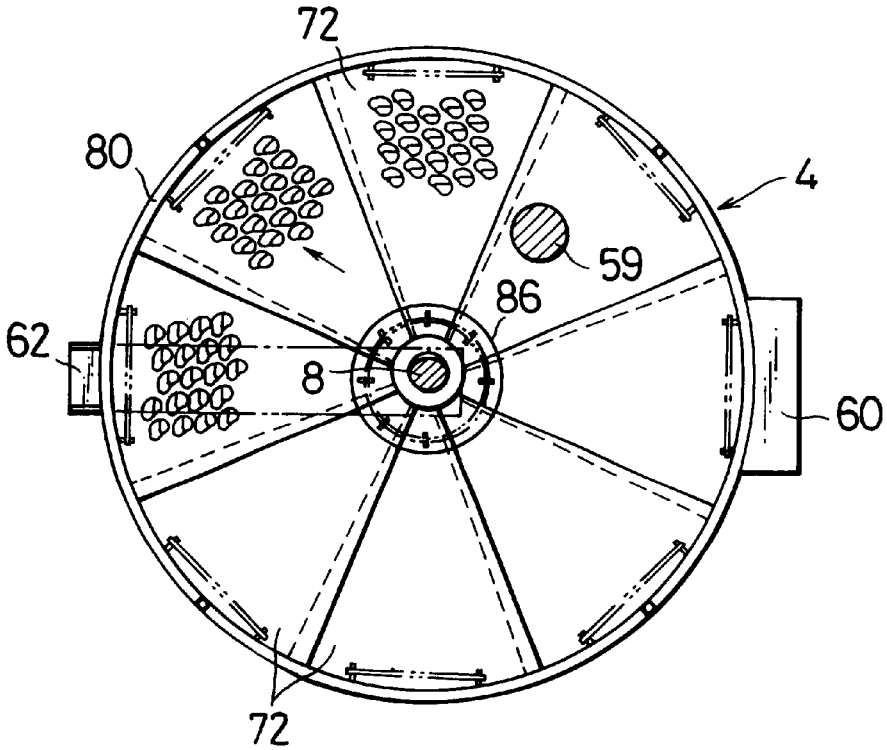
FIG. 19 is a schematic plan view of the separating vessel.

Referring to FIG. 23, a level sensor 94 is further provided for detecting a thickness of the layer of rice mixture on the segmental separating plate 72. The level sensor 94 and said unhulled rice/unpolished rice detecting sensor 93, as shown most obviously in FIG. 18, are mounted to a link mechanism 95 arranged in parallel with the separating plate 72. As for the level sensor 95, a photoelectric switch of distance setting type (available as model No. ES3-CL from Omron Corp., Japan) or an analog output photoelectric sensor may be employer therefor.

Figure 24:
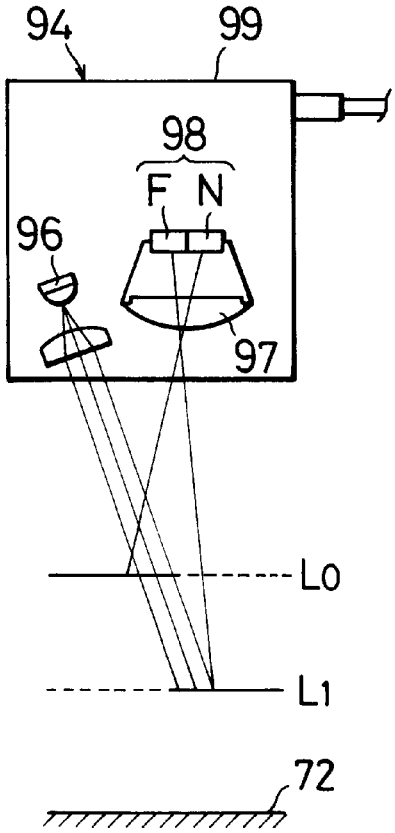
FIG. 24 is a diagram illustrating an operation of a level sensor in detecting a layer thickness.

FIG. 24 shows an operation of a photoelectric switch 94 of distance setting type in detecting a thickness of a layer. This photoelectric switch of distance setting type comprises: a projecting portion 96 for irradiating parallel rays toward a detecting region; a light receiving lens 97 for condensing reflected light from an object to be detected; a half-split light receiving element 98 arranged behind said light receiving lens 97 and composed of a photodiode N for proximal side of light receiving and another photodiode F for distal side of light receiving; and a case 99 containing above elements therein. The level sensor 94 monitors a position of the rice mixture on the separating plate 72 comparing with a setting distance from the upper limit position "L0" of the rice mixture (for example, a distance from the separating plate 72 is 15 mm) to the photodiode N, and also comparing with a setting distance from the lower limit position "L1" of the rice mixture (for example a distance from the separating plate 72 is 10 mm) to the photodiode F Thus, an appropriate level in thickness of the rice mixture falls in the range between L0 and L1. Thereby, the operation of the reversible motor 77 can be controlled by switching on/off operation of the photodiodes N or F.

When the layer thickness of the rice mixture reaches to L1 level from the separating plate 72 immediate after the beginning of separating operation, both of the photodiodes F and N are off and a normal rotation circuit is actuated to rotationally drive the reversible motor 77 in the normal direction so that the inclination angle of the separating plate 72 may be increased to be steep. When the layer thickness increases from L1 level to L0 level, the photodiode F is switched on and the photodiode N is switched off, so that the normal rotation circuit can not be actuated to stop the reversible motor 77. When the layer thickness exceeds L0 level, both of the photodiodes F and N are on and thereby a reverse rotation circuit is actuated to rotationally drive the reversible motor 77 in the reverse direction so that the inclination angle of the separating plate 72 may be decreased to be gentle.

Figure 25:
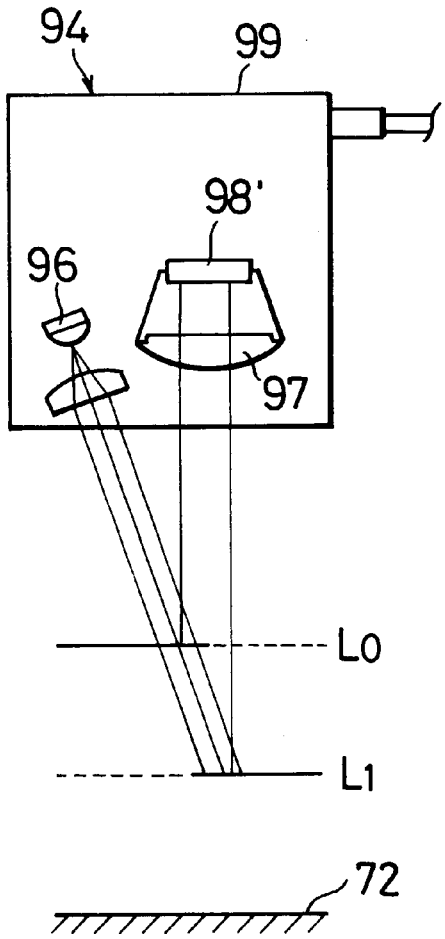
FIG. 25 is a diagram illustrating an operation of another level sensor in detecting a layer thickness.

FIG. 25 shows an operation of an analog output photoelectric sensor in detecting a thickness of a layer. The analog output photoelectric sensor comprises: a projecting portion 96 for irradiating parallel rays toward a detecting region; a light receiving lens 97 for condensing reflected light from an object to be detected; a light receiving element 98' arranged behind said light receiving lens 97; and a case 99 containing above elements therein; wherein outputs from the light receiving element 98' at the upper and the lower limit levels are set as upper and lower thresholds respectively, and if the output from the light receiving element is within the range between the thresholds, then the angle of the separating plate 72 is determined to be appropriate and the reversible motor 77 is not driven, while if the output is over the upper threshold or under the lower threshold, the reversible motor 77 is rotationally driven to decrease or increase the inclination angle of the separating plate 72.

Figure 26:
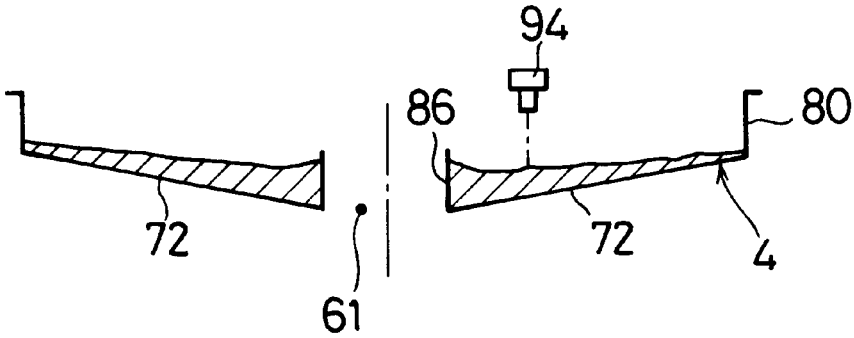
FIG. 26 is a diagram illustrating a relation between a level sensor and a separating condition on separating plates.

As having been described above, since the level sensor is located in rather proximal side to the center of the separating plate 72 and detects the layer thickness at that region to regulate the inclination angle of the separating plate 72, the rice mixture is distributed over the separating plate 72 with the layer thickness being thicker in central side gradually getting thinner toward the peripheral side (see FIG. 26), so that such risk can be reduced that the unhulled rice might be discharged from the unpolished rice discharging port by the centrifugal force.

AVAILABILITY TO INDUSTRIAL USE

As having been described above, since the present invention provide a rotary shaking separator comprising; a separating vessel having a plurality of segmental separating plates arranged in the cone-shaped form; and a drive means for rotationally shaking said separating vessel, so that once material to be separated, that is mixture composed of unhulled rice and unpolished rice, is supplied into a predetermined location of said separating vessel, the components of said mixture are discharged respectively in such a way that said unhulled rice are discharged from a peripheral edge of said separating vessel and said unpolished rice from a central bottom portion of said separating vessel; wherein said separating vessel is supported at peripheral edge portions by a plurality of drive means arranged in said peripheral edge portions on the same radii from the center of said separating vessel with arc lengths thereof being equal to one another so that said peripheral edge portions of said separating vessel may be sequentially driven elliptically by said plurality of drive means to rotationally shake the whole of said separating vessel, and as a result, the present invention has made it possible to retain a constant level of separating accuracy without any failure in separation which might otherwise occur on the same separating plate, and further to provide a rotary shaking separator which requires no rotary shaft inserted through the central portion of the separating vessel, thereby eliminating such defects that mounting is difficult, maintenance is troublesome, or discharging of unhulled iice is not facilitated.

Further, even in the case where a plurality of said circular sets of separating plates are arranged in multi-row, since all units of the separating plates can be driven with a synchronous and steady rotational shaking motion as a whole, a failure in separation cannot occur on the same separation frame, thereby enhancing a separating ability proportional to the number of rows.

What is claimed is:

1. A rotary shaking separator comprising:

a separating vessel having a plurality of segmental separating plates arranged in a cone-shaped form; and a drive means for rotationally shaking said separating vessel, so that once mixture composed of unhulled rice and unpolished rice is supplied into a predetermined position of said separating vessel, the components of said mixture are discharged respectively in such a way that said unhulled rice is discharged from a peripheral edge of said separating vessel and said unpolished rice from a central bottom portion of said separating vessel;

wherein said drive means includes a plurality of drives;

wherein said separating vessel is supported by said plurality of drives which are arranged in peripheral edge portions on the same radii from the center of said separating vessel with arc lengths thereof being equal to one another; and said peripheral edge portions of said separating vessel are sequentially driven elliptically by said plurality of drives so that the whole of said separating vessel is shaken rotationally.

2. A rotary shaking separator in accordance with claim 1, in which a plurality of electric motors are provided corresponding to said plurality of drives as one-by-one.

3. A rotary shaking separator in accordance with claim 2, further comprising:

a measuring unit for measuring a number of revolutions of a drive shaft of each of said electric motors when said plurality of electric motors is operated synchronously; and a controller for controlling every electric motor to have a predetermined number of revolutions based on an output from said measuring unit as well as for synchronously operate each one of said plurality of electric motors with a predetermined phase delay therebetween.

4. A rotary shaking separator in accordance with claim 1, in which a single electric motor is used to actuate said plurality of drives.

5. A rotary shaking separator in accordance with claim 4, said drive means comprises:

an input shaft rotatably arranged laterally so as to transmit a revolution from said electric motor;

an intermediate shaft connected to said input shaft via a universal joint; and an eccentric shaft axially attached to said intermediate shaft;

wherein said peripheral edge portion of said separating vessel is laterally supported by said eccentric shaft to give an elliptical motion to said peripheral edge portion.

6. A rotary shaking separator in accordance with either of claim 2 or 3, in which each of said plurality of drives comprises:

an input shaft rotatably arranged vertically so as to transmit a revolution from said electric motor;

a swash plate cam axially attached to said input shaft; and an output shaft which follows displacement caused by a revolution of said swash plate cam to make an elliptical locus;

wherein said peripheral edge portion of said separating vessel is supported from under side by said output shaft to give an elliptical motion to said peripheral edge portion.

7. A rotary shaking separator in accordance with either of claim 2 or 3, in which each of said plurality of drives comprises:

an input shaft rotatably arranged vertically so as to transmit a revolution from said electric motor;

a cam member through which said input shaft is inserted and to which a swash plate cam is axially attached; and an output shaft which is slidably moved on said swash plate cam by the revolution of said input shaft and makes an elliptical locus by displacement rotationally moving up and down;

wherein, said peripheral edge portion of said separating vessel is supported from under side by said output shaft to give an elliptical motion to said peripheral edge portion.

8. A rotary shaking separator in accordance with either of claim 2 or 3, in which each of said plurality of drives comprises:

an input shaft rotatably arranged obliquely so as to transmit a revolution from said electric motor;

an eccentric shaft axially attached to said input shaft;

a crank plate for converting a true circular motion of said eccentric shaft to an elliptical motion; and an output shaft axially attached to said crank plate to make an elliptical locus;

wherein, said peripheral edge portion of said separating vessel is obliquely supported from under side by said output shaft to give an elliptical motion to said peripheral edge portion.

9. A rotary shaking separator in accordance with claim 1 in which a plurality of said separating vessels are arranged in a multi-row configuration.

10. A rotary shaking separator in accordance with claim 9, further comprising:

a circular dam disposed on said separating plates in a center of each of said separating vessels and having a unhulled rice discharging port;

a shutter for opening or closing said unhulled rice discharging port; and a unit for actuating said shutter;

wherein said unit for actuating said shutter is actuated in response to an output signal from a unhulled rice/unpolished rice detection sensor for distinguishing unhulled rice and unpolished rice in rice mixture from each other on the separating plates.

11. A rotary shaking separator in accordance with claim 10, in which each of said separating plates of each of said separating vessels is constructed such that an inclination angle thereof is allowed to be regulated respectively, and said separator further comprises a regulator unit for regulating the inclination angle of said separating plate.

12. A rotary shaking separator in accordance with claim 11, further comprising a level sensor for detecting a layer thickness of the rice mixture on said separating plates, wherein when said level sensor detects a level in thickness of said rice mixture being over or under predetermined levels, said regulator unit is actuated to set the inclination angle of said separating plate toward a gentle angle direction or toward a steep angle direction.

* * * * *